US006409632B1

(12) United States Patent
Eschenbach

(10) Patent No.: US 6,409,632 B1
(45) Date of Patent: Jun. 25, 2002

(54) COMPACT ELLIPTICAL EXERCISE MACHINE

(76) Inventor: Paul William Eschenbach, 143 Lakeland Ave., Moore, SC (US) 29369

( * ) Notice: Subject to any disclaimer, the term of this patent is extended or adjusted under 35 U.S.C. 154(b) by 4 days.

(21) Appl. No.: 09/723,272

(22) Filed: Nov. 28, 2000

Related U.S. Application Data

(63) Continuation-in-part of application No. 09/478,782, filed on Jan. 7, 2000, which is a continuation-in-part of application No. 09/067,261, filed on Apr. 27, 1998, now Pat. No. 6,142,915, which is a continuation-in-part of application No. 08/711,087, filed on Sep. 9, 1996, now Pat. No. 5,788,610.

(51) Int. Cl.[7] ..... A63B 69/16; A63B 22/04
(52) U.S. Cl. ..... 482/52; 482/57
(58) Field of Search ..... 482/51, 52, 53, 482/57, 70, 79, 80

(56) References Cited

U.S. PATENT DOCUMENTS

| | | | | |
|---|---|---|---|---|
| 5,529,555 A | | 6/1996 | Rodgers, Jr. | 482/57 |
| 5,577,985 A | | 11/1996 | Miller | 482/52 |
| 5,800,315 A | | 9/1998 | Yu et al. | 482/57 |
| 5,803,872 A | | 9/1998 | Chang | 482/52 |
| 5,836,854 A | * | 11/1998 | Kuo | 482/52 |
| 5,865,712 A | | 2/1999 | Chang | 482/57 |
| 5,893,820 A | * | 4/1999 | Maresh et al. | 482/51 |
| 6,077,198 A | * | 6/2000 | Eschenbach | 482/52 |

* cited by examiner

*Primary Examiner*—Stephen R. Crow

(57) ABSTRACT

The present invention relates to a standup exercise apparatus that simulates walking, jogging and climbing with arm exercise. More particularly, the present invention relates to an exercise machine having separately supported pedals for the feet and arm exercise coordinated with the motion of the feet.

Elliptical trainers guide the feet along a generally elliptical shaped curve to simulate the motions of jogging and climbing. Existing elliptical trainers consume excessive floor-space having shrouds at one or both ends.

The present invention is an improved elliptical exercise machine capable of extended exercise with a long stride comparable to existing cross trainers. A shroud which also serves as a step platform is located under the pedals containing the crank, pedal guidance linkage and load resistance. Further, the elliptical trainer is more compact with a smaller footprint to conserve floor space. Handles are connected to the pedals for coordinated arm exercise.

27 Claims, 5 Drawing Sheets

COMPACT ELLIPTICAL EXERCISE MACHINE

This application is a Continuation-in-Part of application Ser. No. 09/478,782 filed Jan. 7, 2000 which is a Contination-in-Part of Ser. No. 09/067,261 filed Apr. 27, 1998 now U.S. Pat. No. 6,142,915 which is a Continuation-in-Part of 08/711,087 filed Sep. 9, 1996 U.S. Pat. No. 5,788,610.

BACKGROUND OF THE INVENTION

1. Field

The present invention relates to a standup exercise apparatus that simulates walking, jogging and climbing with arm exercise. More particularly, the present invention relates to an exercise machine having separately supported pedals for the feet and arm exercise coordinated with the motion of the feet.

2. State of the Art

The benefits of regular exercise to improve overall health, appearance and longevity are well documented in the literature. For exercise enthusiasts the search continues for safe apparatus that provides full body exercise for maximum benefit in minimum time.

Recently, a new category of exercise equipment has appeared on the commercial market called elliptical cross trainers. These cross trainers guide the feet along a generally elliptical shaped curve to simulate the motions of jogging and climbing. Generally they are large exercise machines using long cranks to generate a long foot stride. There is a need for a more compact elliptical exercise machine capable of a similar long stride using a linkage to modify the crank.

Recently, there has been an effort to improve the up and down motion of stair climbers by the addition of horizontal movements. Habing in U.S. Pat. Nos. 5,299,993 and 5,499,956 offers an articulated linkage controlled through cables by motor to move pedals through an ovate path. Both pedal pivots follow basically the same guidance path curve directed by a motor controller. Stearns in U.S. Pat. Nos. 5,290,211 and 5,299,993 shows a stair stepping exercise machine which incorporates horizontal movement using a combination of vertical parallelogram linkage and horizontal parallelogram linkage to guide the foot pedals. The parallelogram linkages serve to maintain the pedal at a constant angle relative to the floor during a pedal cycle. The pedal pivots move through similar undefined guide paths. Eschenbach in U.S. Pat. No. 5,279,529 shows several embodiments of elliptical pedal motion configured to maintain the heel of the user on the pedal during a substantial portion of the pedal cycle.

Standup pedal exercise is shown in U.S. Pat. No. 4,643,419 (Hyde) and by Jarriel et al. In U.S. Pat. No. D330,236 where pedal platforms move by dual crank motion but remain parallel to the floor. Knudsen in U.S., Pat. No. 5,433,680 shows an elliptical path generating mechanism with pedals having only one pivot allowing the pedal to rotate unconstrained about the pivot as in a bicycle crank.

Standup pedal exercise combined with arm levers attached to the pedals is shown in Kummerlin et al. German Pat. No. 2,919,494 and in Geschwender U.S. Pat. No. 4,786,050. Standup pedal exercise coupled with oscillating swing arms is shown in Miller U.S. Pat. Nos. 5,242,343 and 5,383,829 and in Eschenbach U.S. Pat. No. 5,423,729. All of these exercise machines use pedals having two pedal pivots which are guided by a first circular guide path curve generated by a crank which rotates through one full revolution during a pedal cycle and a second arc guide path curve generated by a rocker link or track.

Recently, numerous elliptical exercise machines have appeared in the patent literature. Rogers,Jr. in U.S. Pat. Nos. 5,527,246, 5,529,555, 5,540,637, 5,549,526, 5,573,480, 5,591,107, 5,593,371, 5,593,372, 5,595,553, 5,611,757, 5,637,058, 5,653,662 and 5,743,834 shows elliptical pedal motion by virtue of various reciprocating members and geared linkage systems. Miller in U.S. Pat. Nos. 5,518,473, 5,562,574, 5,611,756, 5,518,473, 5,562,574, 5,577,985, 5,755,642 and 5,788,609 also shows elliptical pedal motion using reciprocating members and various linkage mechanisms along with oscillating guide links with control links to determine pedal angles. Ryan et al. in U.S. Pat. No. 5,899,833 shows an elliptical cross trainer having a forward crank driving a pedal linkage underneath the operator.

Chang in U.S. Pat. No. 5,803,872 and Yu et al. in U.S. Pat. No. 5,800,315 show a pedal supported by a rocker link and driven with a pair of links located under the pedal pivotally connected to a crank. Maresh et al. in U.S., Pat. No. 5,792,026 show a foot support member supported by a rocker link and driven by a double crank mechanism. Maresh in U.S. Pat. No. 5,897,463 shows a foot platform with parallel movement as the the foot platform follows an oval path. Lee in U.S. Pat. No. 5,779,598 and Chen in U.S. Pat. No. 5,823,914 show a pedal link driven by two separate cranks. Lin et al. in U.S. Pat. No. 5,769,760 offers elliptical foot and hand motion. Sands et al. U.S. Pat. No. 5,755,643 shows elliptical foot motion with folding front post.

Lee in U.S. Pat. No. 5,746,683 shows a foot support member supported on one end with a compound rocker wherein a slider and handle lever support the rocker. Kuo in U.S. Pat. No. 5,836,854 offers a linear foot support member connected on one end to a crank and guided along an arcuate curve under the pedal by a linkage on the other end. Wang et al. U.S. Pat. No. 5,830,112 shows a foot support member sliding on a pivot on one end and attached to a crank on the other that can fold. Chen U.S. Pat. No. 5,823,917 shows a foot support member driven by a crank on one end and supported by a stationary roller on the other. Chen U.S. Pat. No. 5,820,524 offers a slider crank mechanism having a pedal pivotally attached with a control link to articulate the pedal angle.

Chen U.S. Pat. Nos. 5,779,599 and 5,762,588 shows an elliptical pedal movement with a roller interface between the foot support member and crank. Chen in U.S. Pat. No. 5,759,136 shows a foot support member with a moving pedal for adjustable elliptical motion wherein a link from the pedal to the crank can be repositioned to change the pedal stroke length. Kuo U.S. Pat. No. 5,846,166 shows a foot support member guided on one end by a roller and driven on the other end by a four bar linkage. Stearns et al. in U.S. Pat. No. 5,848,954 offers a foot support member pivoted on one end with a lift crank on the other and a pedal moving on the foot support member to generate elliptical type foot motion.

There is a need for a compact pedal operated exercise machine that can be safely operated in the standup position having a long pedal stroke whereby the arms and legs can be exercised with the feet moving through a generally elliptical movement.

It is one objective of this invention to provide an elliptical pedal movement with a crank linkage that provides a compact and simple exercise machine with a small footprint. Another object of this invention is to contain the driving linkage under the pedals. Yet another object of this invention is to provide arm exercise that is coordinated with the pedal movement.

SUMMARY OF THE INVENTION

The present invention relates to the kinematic motion control of pedals which simulate running, climbing and cycling. More particularly, apparatus is provided that offers variable intensity exercise through a leg operated cyclic motion in which the pedal supporting each foot is guided through successive positions during the motion cycle while a load resistance acts upon the mechanism.

The pedals are guided through an oblong or elongate curve motion while pedal angles vary during the pedal cycle to maintain the heel of the foot generally in contact with the pedal. As the foot is raised, the heel of the foot remains generally in contact with the inclining pedal for safer operation. Arm exercise is by arm levers coordinated with the mechanism guiding the foot pedals.

In the preferred embodiment, the apparatus includes a separate pedal for each foot, each pedal being extended by a foot support member having a first portion and a second portion. A rotary crank is attached to the framework under the foot support member proximate the floor. The crank completes one full revolution during a pedal cycle and is phased generally opposite the crank for the other pedal through a crankshaft bearing housing attached to the framework.

A rocker link is pivotally connected at one end to the framework proximate the floor. A coupler link is connected to the crank at a crank pivot and the rocker link is connected to the coupler link at a rocker pivot positioned intermediate the ends to cause the rocker link to oscillate back and forth as the crank turns. The other end of the rocker link is pivotally connected to the first portion of the foot support member to guide for back and forth movement.

A lifter link is pivotally connected to the coupler link and to the second portion of the foot support member causing the second portion to have an up and down movement as the crank turns. The lifter link, rocker link and coupler link comprise a linkage that supports the foot support member from underneath. The linkage together with the crank and foot support member cause the pedal to follow an elongate curve similar to an ellipse.

Arm exercise is provided with handles pivotally connected to the framework. A connecting link is pivotally connected to each handle and each foot support member to coordinate the arm movement with the foot. When the foot is forward, the handle corresponding to that foot is generally rearward. The connecting link could also be connected to the pedal, rocker link or coupler link for similar coordination.

A step surface is provided as part of the shroud to mount the pedals from the rear or side. The shroud is close to the floor to completely contain the load resistance, crank, coupler links and lower portion of the rocker links. Slots provided on the step surface allow the upper portion of the rocker links and lifter links to protrude for support of each foot support member located above the step surface.

In an alternate embodiment, the first portion of the foot support member is is guided for back and forth movement by an extension of the handle for arm exercise. The connecting link of the preferred embodiment now becomes a control link pivotally connected to one end of the rocker link and intermediate the lifter link. The lifter link, control link, coupler link and rocker link becomes the linkage that supports the second portion of the foot support member.

In another alternate embodiment, the linkage comprising the lifter link, control link, coupler link and rocker link of the alternate embodiment support the second portion of the foot support member from underneath. A roller has been added to the first portion of the foot support member. A track guides the roller for back and forth movement. An actuator can reposition the track to change the pedal motion. A control system within easy reach of the operator allows the actuator to be operative during operation of the exercise machine to change pedal motion. Arm exercise is connected to the foot support member similar to the preferred embodiment.

Load resistance is imposed upon the crank for each embodiment through a first pulley attached to the crank which is engaged by belt to second pulley supported by a jackshaft. A third pulley is attached to the jackshaft to drive a flywheel and alternator. The alternator can be varied during operation through a control system within easy reach of the operator. Other forms of load resistance such as friction discs, magnetic, air, friction belt, etc. may also be used.

In summary, this invention provides the operator with stable foot pedal support having motions that simulate running, climbing and cycling with very low joint impact and upper body exercise in a compact space having a small footprint. The linkage driven by the pedals and load resistance are contained in a shroud positioned close to the floor. The pedal stroke is considerably longer than the crank stroke. Arm exercise is coordinated with the pedal motion.

DETAILED DESCRIPTION OF THE EMBODIMENTS

Figure 1:
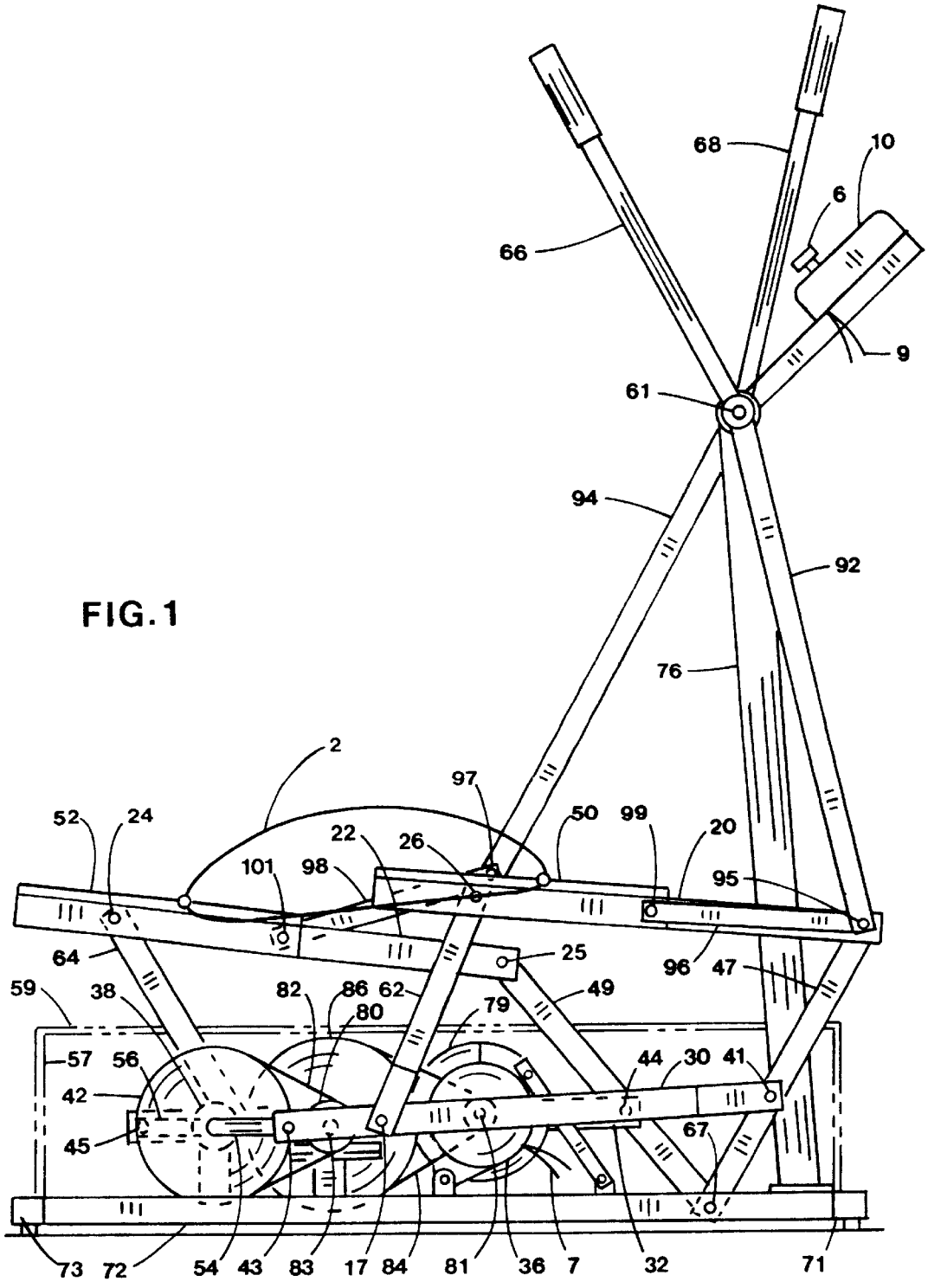
FIG. 1 is a right side elevation view of the preferred embodiment of an exercise machine constructed in accordance with the present invention.
Figure 2:
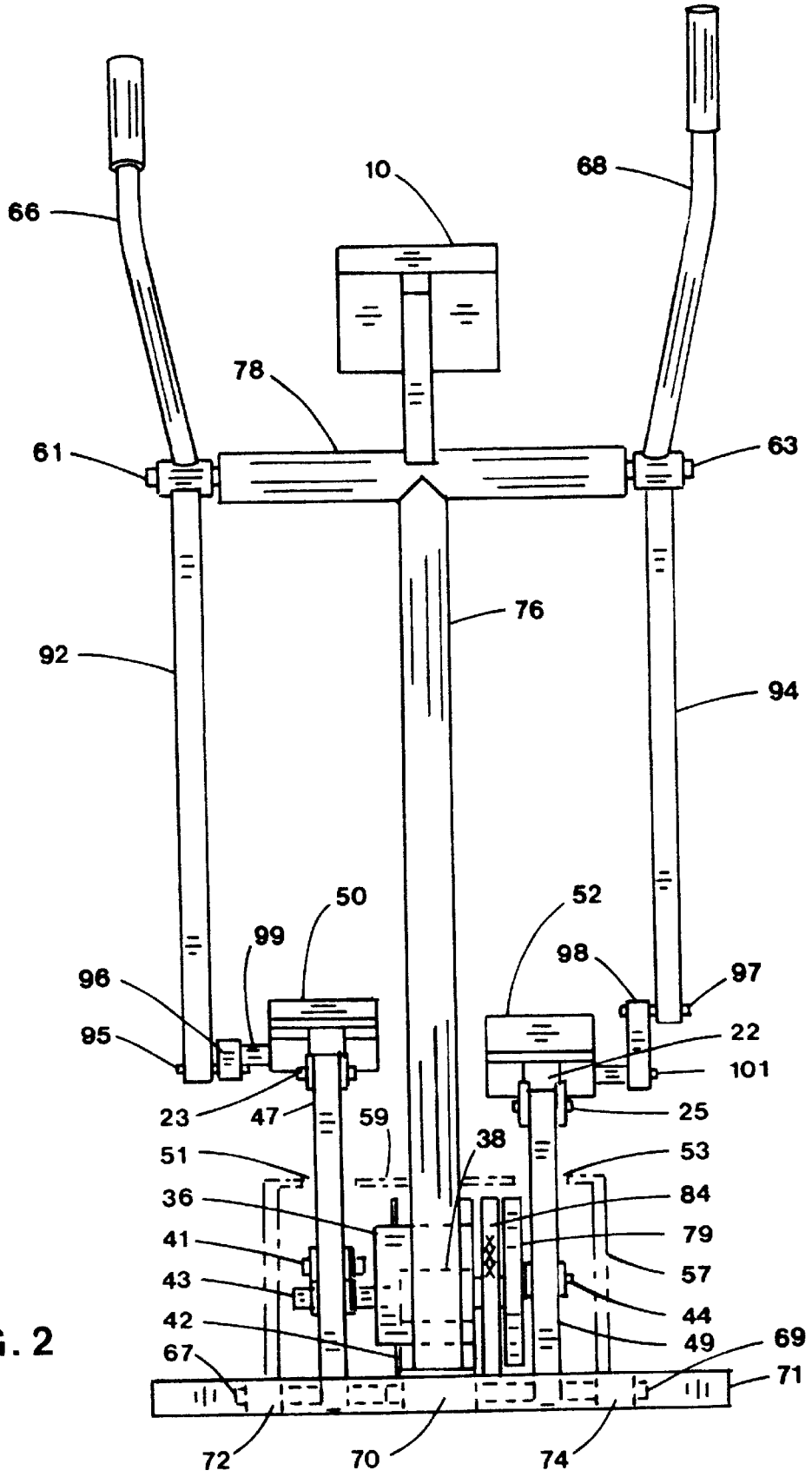
FIG. 2 is the front view of the preferred embodiment shown in FIG. 1.
Figure 3:
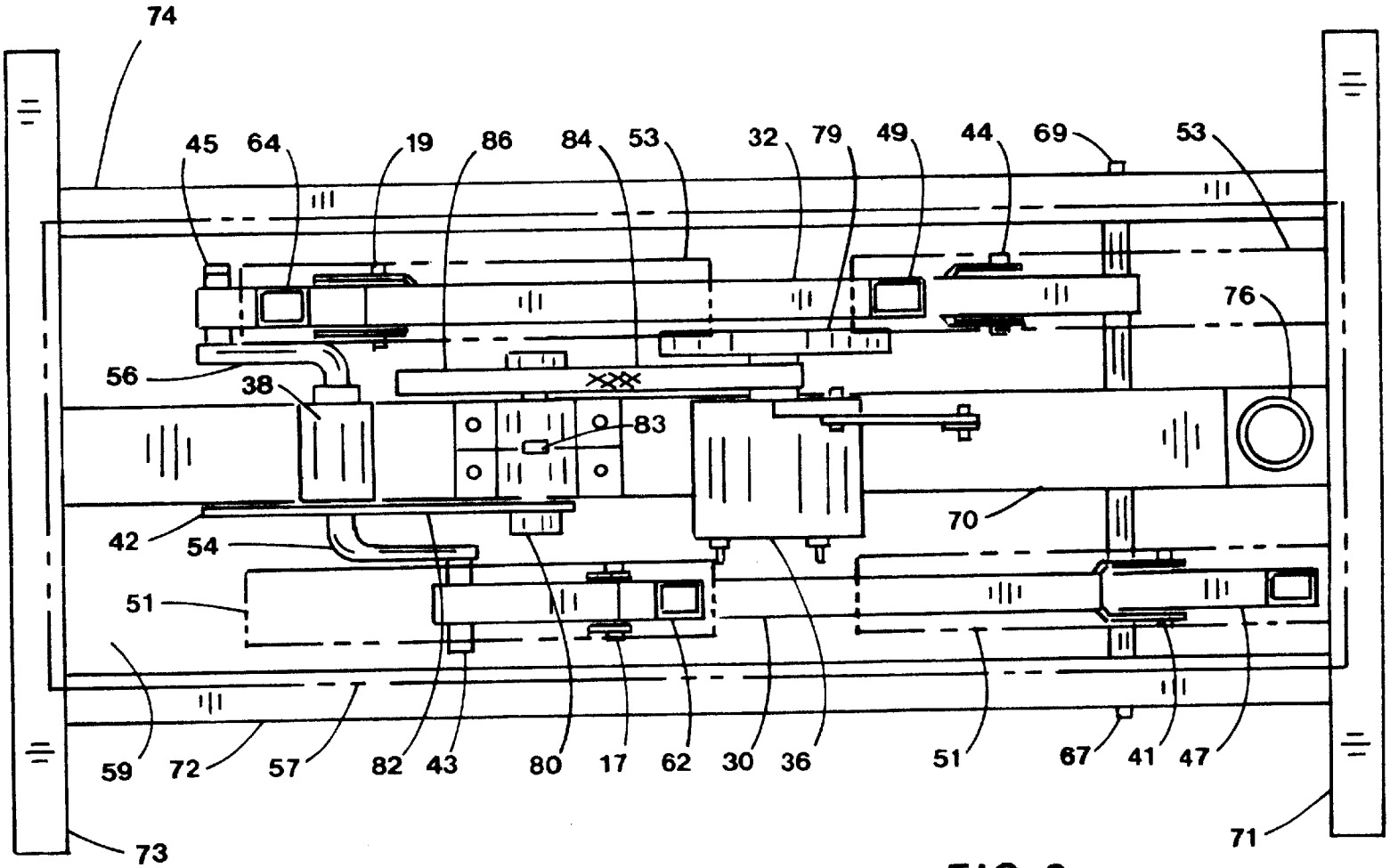
FIG. 3 is a plan view of the preferred embodiment shown in FIGS. 1 and 2 below the foot support members.

Referring to the drawings in detail, pedals 52 and 50 are shown in FIGS. 1, 2 and 3 in the most forward and rearward positions of the preferred embodiment. Pedals 50 and 52 are supported by foot support members 20 and 22 which have first foot support pivots 23,25 in a first portion and second foot support pivots 26,24 in a second portion, respectively. Pedals 50,52 are positioned in the second portion of foot support members 20,22. Foot support pivots 23 and 25 are pivotally attached to rocker link guides 47 and 49 which are connected to frame members 70,72,74 at pivots 67,69 positioned close to the floor.

Cranks 54 and 56 are connected in opposing directions by crankshaft journal 55 (not shown) which is rotatably secured to the frame member 70 by bearing housing 38. Coupler links 30,32 are connected to rocker links 47,49 at pivots 41,44 and to cranks 54,56 at pivots 43,45. Rotation of cranks 54,56 cause rocker links 47,49 to oscillate back and forth.

Lifter links 62,64 are connected to the second portion of foot support members 20,22 at pivots 26,24 and to coupler links 30,32 at pivots 17,19. The pivots 17,19 can be located any where along the length or width of coupler links 30,32 including any extensions (not shown). Lifter links 62,64, rocker links 47,49 and coupler links 30,32 form a linkage that acts with cranks 54,56 to control the movement of foot support members 20,22.

Handles 66,68 are attached to crossover member 78 at pivots 61,63 for arm exercise. Handle extension links 92,94 are offset relative to handles 66,68. Connector links 96,98 are connected to handle extension links 92,94 by pivots 95,97 and to foot support members 20,22 at pivots 99,101.

Frame members 70, 72 and 74 are attached to crossover members 71,73 configured to be supported by the floor. Frame member 76 is attached to frame members 70,71 and supports crossover member 78.

Flywheel 79 is rotatably supported at pivot 81 which is part of alternator 36 attached to frame member 70. Belt 84 connects flywheel 79 to pulley 86 which is supported by jackshaft 83 also supported by frame member 70. Pulley 80 on jackshaft 83 is engaged with belt 82 which is also engaged with pulley 42 attached to cranks 54,56.

Shroud 57 with step surface 59 is supported by frame members 71,72,73,74 and contains cranks 54,56, coupler links 30,32, pulleys 42,80,86, flywheel 79 and alternator 36. Rocker links 47,49 and lifter links 62,64 protrude upward through slots 51,53 to support foot support members 20,22.

Control system 10 is attached to crossover member 78. Wires 9 are connected to alternator wires 7 by conventional means not shown. The switch 6 can be manually changed during operation by the operator to vary load intensity imposed by alternator 36 or by automatic program.

Application of body weight on the pedals 50,52 and force applied at the arm levers 66,68 cause the flywheel 79 to rotate for a gain in momentum while the pedals 50,52 follow the elongate pedal curve 2 shown in FIG. 1. The flywheel 79 momentum will carry the linkage system through any dead center positions of the crank 54,56. The pedals 50,52 and handles 66,68 can be operated to drive the flywheel 79 in either direction of rotation.

Figure 4:
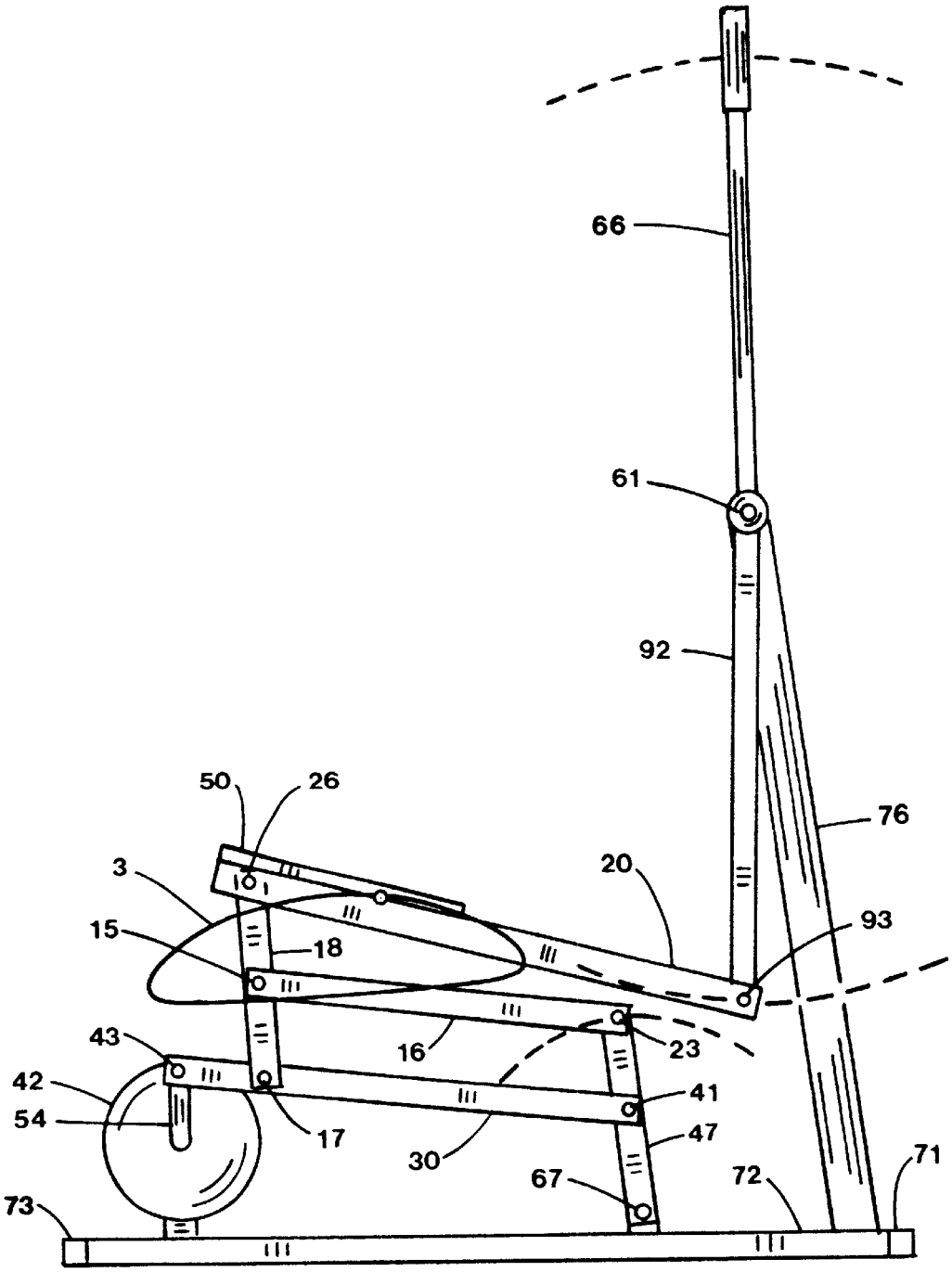
FIG. 4 is a side view of an alternate embodiment showing only one side of the exercise machine.

An alternate embodiment is shown in FIG. 4 with the pedal 50 in the uppermost position. Only one side of the exercise machine is shown for clarity. The first portion of the foot support member 20 is connected to handle extension guide 92 at pivot 93 for back and forth movement. Control link 16 is connected to rocker 47 at pivot 23 and to lifter link 18 at pivot 15. Lifter link 18 is connected to coupler link 30 at pivot 17 and to the second portion of foot support member 20 at pivot 26.

The linkage composed of lifter link 18, control link 16, rocker link 47 and coupler link 30 guide the second portion of foot support member 20 for up and down movement. Rotation of the crank 54 causes pedal 50 to follow elongate curve 3. Load resistance, control system and shroud are similar to the preferred embodiment but not shown for clarity. Frame members 76,78,71,72,73 are similar to the preferred embodiment.

Figure 5:
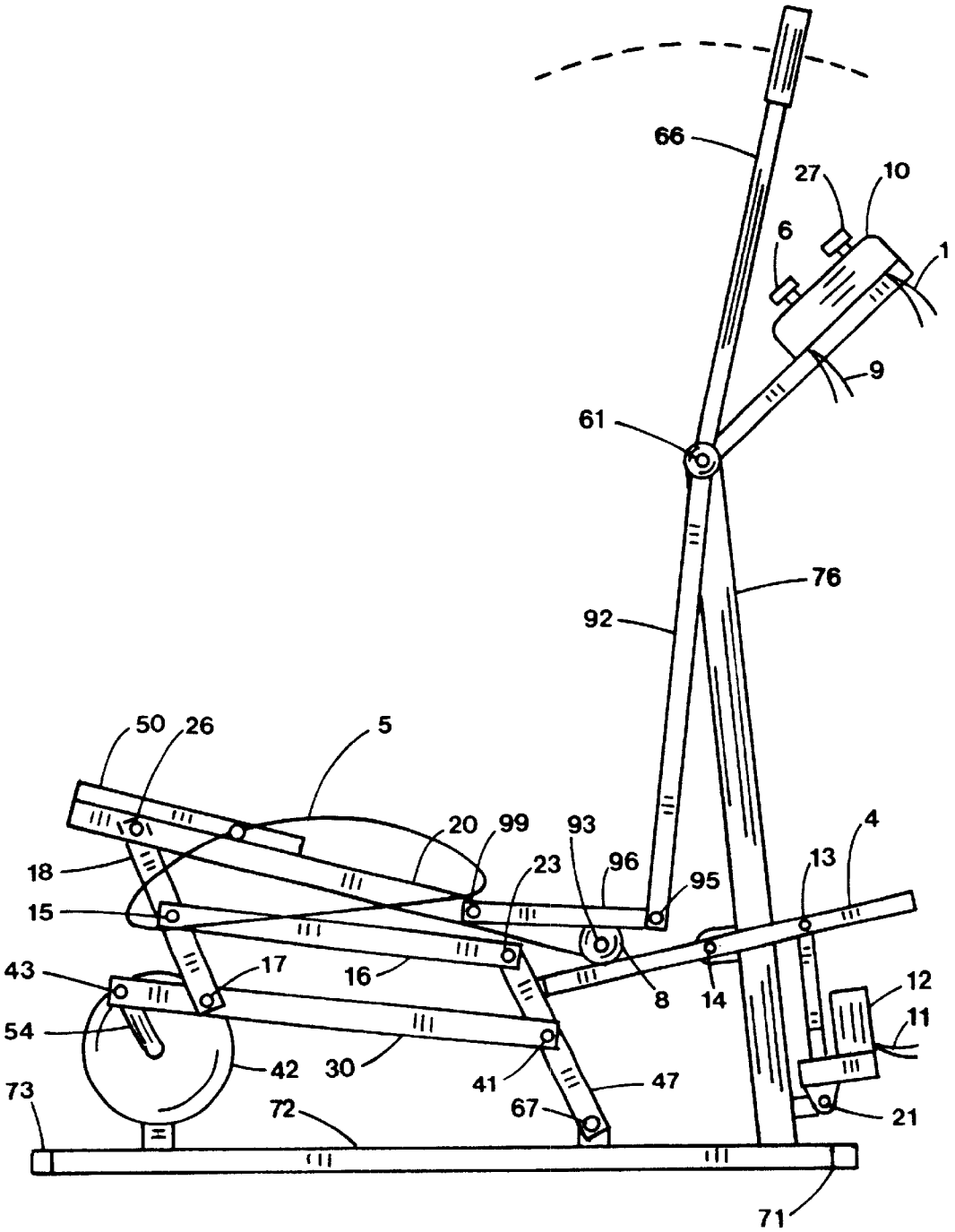
FIG. 5 is a side view of another alternate embodiment showing only one side of the exercise machine.

Another alternate embodiment is shown in FIG. 5 with pedal 50 in a nearly uppermost position. Only one side of the exercise machine is shown for clarity. The linkage composed of lifter link 18, control link 16, rocker link 47 and coupler link 30 guide the second portion of foot support member 20 for up and down movement. Roller 8 is rollably attached to the first portion of foot support member 20 at pivot 93. Track 4 guides roller 8 for back and forth movement. Track 4 is connected to frame member 76 at pivot 14.

Actuator 12 is connected to track 4 at pivot 13 and to frame member 76 at pivot 21. Control system 10 with wires 1 is connected to actuator wires 11 by conventional wiring not shown. Control system knob 27 can be adjusted by the operator or by program to activate the actuator 12 to change pedal motion 5 during operation by moving track 4. Load resistance and shroud are similar to the preferred embodiment but not shown for clarity. Frame members 76,78,71, 72,73 are similar to the preferred embodiment.

The present invention is an improvement over prior art cross trainers because the foot support members 20,22 are positioned above the linkage support and drive system. The footprint of the present invention is approximately one-half the length of the footprint of conventional cross trainers now on the market. However, the pedal curves 2,3,5 are maintained approximately the same length as the full size crosstrainers. This much smaller footprint represents a huge space savings in fitness clubs or in the home.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise machine comprising:

a framework, said framework configured to be supported by the floor;

a pair of foot support members, each having a first portion, a second portion and a foot engaging pedal;

a crank, said crank rotatably attached to said framework projecting outwardly therefrom on both sides thereof;

a pair of guides, each guide operably associated with said first portion of said foot support member to cause said first portion of said foot support member to have generally back and forth movement;

a pair of linkages, each said linkage positioned below said foot support member and operably associated with said crank to cause said second portion of said foot support member to have generally up and down movement;

said linkages including a coupler link, said coupler link pivotally connected to said crank and, a lifter link, said lifter link pivotally connected to said second portion of said foot support member and pivotally connected to said coupler link;

said pedal configured to move relative to said framework when the foot of the user is rotating said crank whereby said pedal follows an elongate curve path.

2. The exercise machine according to claim 1 wherein said elongate curve path is generally elliptical in shape.

3. The exercise machine according to claim 1 wherein each said linkage includes a rocker link, said rocker link pivotally connected to said coupler link and pivotally connected to said framework proximate said floor.

4. The exercise machine according to claim 3 wherein said rocker link is pivotally connected to said first portion of said foot support member to guide said first portion of said foot support member with generally back and forth movement.

5. The exercise machine according to claim 1 wherein said guide comprises a roller, said roller pivotally attached to said first portion of said foot support member and, a track, said track attached to said framework and in rollable contact with said roller to guide said first portion of said foot support member with generally back and forth movement.

6. The exercise machine according to claim 1 wherein said guide comprises an extension link, said extension link pivotally connected to said first portion of said foot support member and pivotally connected to said framework to guide said first portion of said foot support member with generally back and forth movement.

7. The exercise machine according to claim 1 further comprising a means for arm exercise, said means for arm exercise operably associated with said pedal motion.

8. The exercise machine according to claim 7 wherein said means for arm exercise comprises a pair of handles, each said handle pivotally connected to said framework and a pair of connector links, each said connector link operably associated with said handle and said foot support member.

9. The exercise machine according to claim 6 further comprising a pair of handles, each said handle pivotally connected to said framework and operably associated with said extension link for arm exercise.

10. The exercise machine according to claim 1 further comprising a flywheel, said flywheel rotatably connected to said framework and operably associated with said crank.

11. The exercise machine according to claim 1 further comprising a load resistance, said load resistance operably associated with said crank, a means for adjustment of said load resistance and, a control system, said control system positioned within reach of the operator whereby said load resistance can be varied during operation of said exercise machine.

12. The exercise machine according to claim 1 wherein said pedal is positioned on said second portion of said foot support member to cause a portion of said pedal to follow an elliptical curve.

13. The exercise machine according to claim 10 wherein said load resistance is an alternator, said alternator attached to said framework below said foot support member.

14. The exercise machine according to claim 1 further comprising an actuator, said actuator operably associated with said guide to change said pedal motion and, a control system, said control system associated with said actuator to change said pedal motion during operation of said exercise machine.

15. The exercise machine according to claim 3 further comprising a pair of control links, each control link pivotally connected to said rocker link and said lifter link.

16. An exercise machine comprising:

a framework, said framework configured to be supported by the floor;

a pair of foot support members, each having a first portion, a second portion and a foot engaging pedal;

a crank, said crank rotatably attached to said framework projecting outwardly therefrom on both sides thereof;

a pair of rocker links, each said rocker link pivotally connected to said framework proximate said floor;

a pair of coupler links, each coupler link operably associated with said crank and said rocker link to cause said rocker link to oscillate back and forth;

a pair of lifter links, each lifter link operably associated with said coupler link and pivotally connected to said second portion of said foot support member to cause said second portion to have generally up and down movement;

a pair of guides, each guide operably associated with said first portion of said foot support member to cause said first portion of said foot support member to have generally back and forth movement;

said pedal configured to move relative to said framework when the foot of the user is rotating said crank whereby said pedal follows an elongate curve positioned above said crank.

17. The exercise machine according to claim 16 further comprising a pair of control links, each control link pivotally connected to said rocker link and said lifter link.

18. The exercise machine according to claim 16 further comprising a means for arm exercise, said means for arm exercise operably associated with said exercise machine.

19. The exercise machine according to claim 16 further comprising an actuator, said actuator operably associated with said guide to change said pedal motion and, a control system, said control system associated with said actuator to change said pedal motion during operation of said exercise machine.

20. An exercise machine comprising:

a framework, said framework configured to be supported by the floor;

a pair of foot support members, each having a first portion, a second portion and a foot engaging pedal;

a crank, said crank rotatably attached to said framework projecting outwardly therefrom on both sides thereof;

a pair of guides, each guide operably associated with said first portion of said foot support member to cause said first portion of said foot support member to have generally back and forth movement;

a pair of rocker links, each said rocker link pivotally connected to said framework proximate said floor;

a pair of coupler links, each coupler link operably associated with said crank and said rocker link to cause said rocker link to oscillate back and forth;

a pair of lifter links, each lifter link operably associated with said crank and pivotally connected to said second portion of said foot support member to cause said second portion to have generally up and down movement;

a means for arm exercise, said means for arm exercise operably associated with said framework and coordinated with said pedal movement;

said pedal configured to move relative to said framework when the foot of the user is rotating said crank whereby said pedal follows an elongate curve.

21. The exercise machine according to claim 20 wherein said means for arm exercise comprises a pair of handles, each said handle pivotally connected to said framework and operably associated with said foot support member.

22. The exercise machine according to claim 20 further comprising a load resistance, said load resistance operably associated with said crank, a means for adjustment of said load resistance and, a control system, said control system positioned within reach of the operator whereby said load resistance can be varied during operation of said exercise machine.

23. The exercise machine according to claim 20 further comprising an actuator, said actuator operably associated with said guide to change said pedal motion and, a control system, said control system associated with said actuator to change said pedal motion during operation of said exercise machine.

24. The exercise machine according to claim 16 further comprising a shroud, said shroud positioned below said foot support members to enclose said crank and said coupler links.

25. The exercise machine according to claim 20 wherein said guide comprises a roller, said roller pivotally attached to said first portion of said foot support member and, a track, said track attached to said framework and in rollable contact with said roller to guide said first portion of said foot support member with generally back and forth movement.

26. The exercise machine according to claim 20 wherein said guide comprises an extension link, said extension link pivotally connected to said first portion of said foot support member and pivotally connected to said framework to guide said first portion of said foot support member with generally back and forth movement.

27. The exercise machine according to claim 20 further comprising a pair of control links, each control link pivotally connected to said rocker link and said lifter link.

* * * * *